US005435326A

United States Patent [19]

Gentry et al.

[11] Patent Number: 5,435,326

[45] Date of Patent: Jul. 25, 1995

[54] CONTROLLED DELIVERY SMOKING ARTICLE AND METHOD

[75] Inventors: Thomas L. Gentry, Winston-Salem; Russell D. Barnes, Belews Creek; Richard L. Blakley, Pfafftown; Charles R. Ashcraft, Winston-Salem; Juanilla M. Gwyn, Winston-Salem; James W. Pryor, Winston-Salem; Henry T. Ridings, Lewisville; Milly M. L. Wong, Winston-Salem, all of N.C.

[73] Assignee: R. J. Reynolds Tobacco Company, Winston-Salem, N.C.

[21] Appl. No.: 97,822

[22] Filed: Jul. 27, 1993

[51] Int. Cl.[6] ..... A24D 3/00; A24D 3/02; A24D 3/04

[52] U.S. Cl. ..... 131/344; 131/338; 131/339

[58] Field of Search ..... 131/331, 332, 336, 338, 131/339-342, 344

[56] References Cited

U.S. PATENT DOCUMENTS

| | | | |
|---|---|---|---|
| 2,900,989 | 8/1959 | Davidson | 131/342 |
| 4,291,712 | 9/1981 | Koster et al. . | |
| 4,393,885 | 7/1983 | Silberstein . | |
| 4,460,001 | 7/1984 | Browne et al. . | |
| 4,469,112 | 9/1984 | Browne et al. . | |
| 4,585,015 | 4/1986 | Silberstein . | |
| 4,754,766 | 7/1988 | Luke et al. . | |
| 4,821,750 | 4/1989 | Browne . | |
| 4,942,887 | 7/1990 | Abdelgawad et al. . | |
| 4,971,078 | 11/1990 | Deutsch et al. . | |
| 4,984,588 | 1/1991 | Stewart, Jr. . | |

FOREIGN PATENT DOCUMENTS

| | | | |
|---|---|---|---|
| 0481596A1 | 4/1992 | European Pat. Off. . | |
| 0295835B1 | 9/1992 | European Pat. Off. . | |
| 1428018 | 3/1976 | United Kingdom . | |
| 2212705 | 8/1989 | United Kingdom | 131/342 |

OTHER PUBLICATIONS

Exhibit A, a handout believed to have been prepared by Hoechst Celanese Corporation, Charlotte, N.C. in about 1980 relating to Constant Delivery Filters.

Exhibit B, a handout believed to have been prepared by Hoechst Celanese Corporation in about 1980, relating to tube in tow filters.

*Primary Examiner*—Jennifer Bahr

[57] ABSTRACT

A smoking article having a controlled yield of wet particulate matter and a method of making a smoking article with predetermined total and per puff yields of wet particulate matter. The smoking article has a tobacco rod connected to an air ventilated compound filter having two abutted filter segments, a rod end segment with a passage therethrough and a mouth end segment. The pressure drop of the abutment interface between the segments is selected to be in a range of from about 10 mm to about 100 mm water gauge. The total pressure drop of the filter including the interface and the amount of air dilution can be selected to provide a smoking article with a level per puff yield or a decreasing per puff yield.

25 Claims, 3 Drawing Sheets

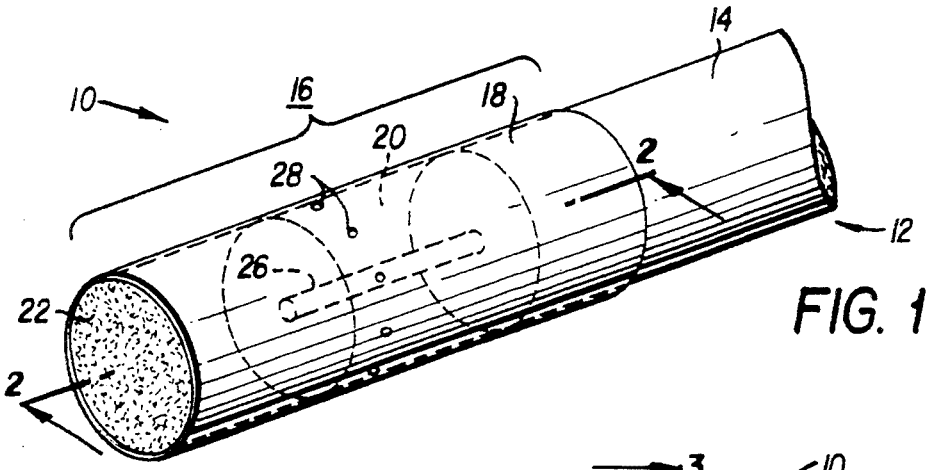
FIG. 1
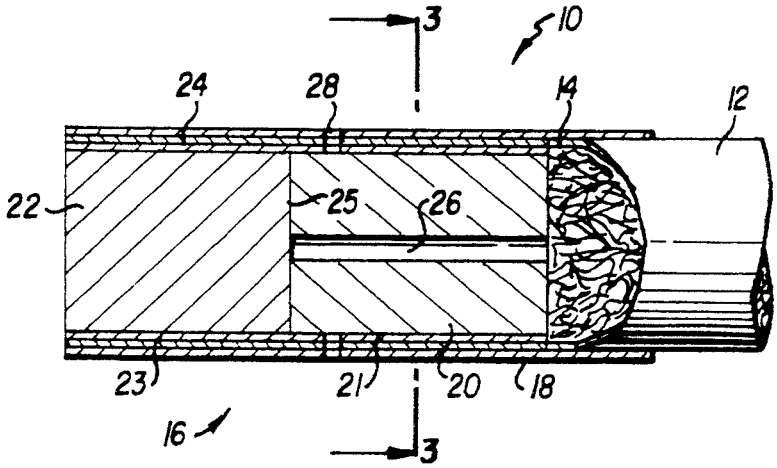
FIG. 2
FIG. 3
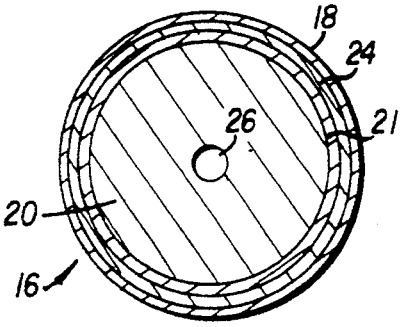
FIG. 3A
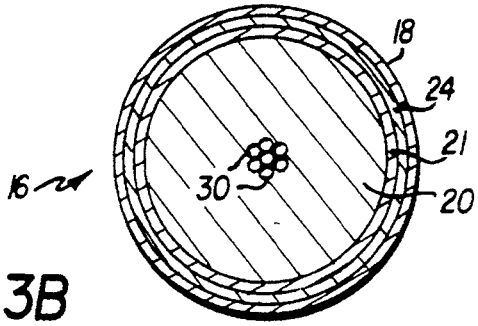
FIG. 3B
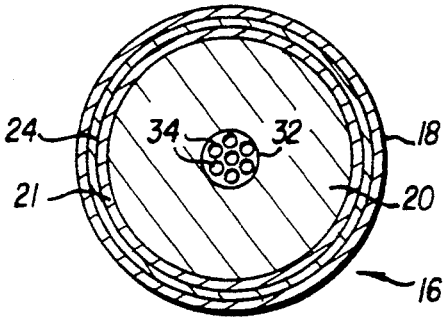

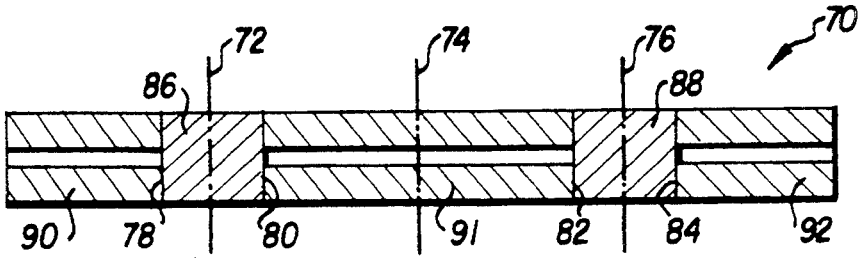
FIG. 4
FIG. 5
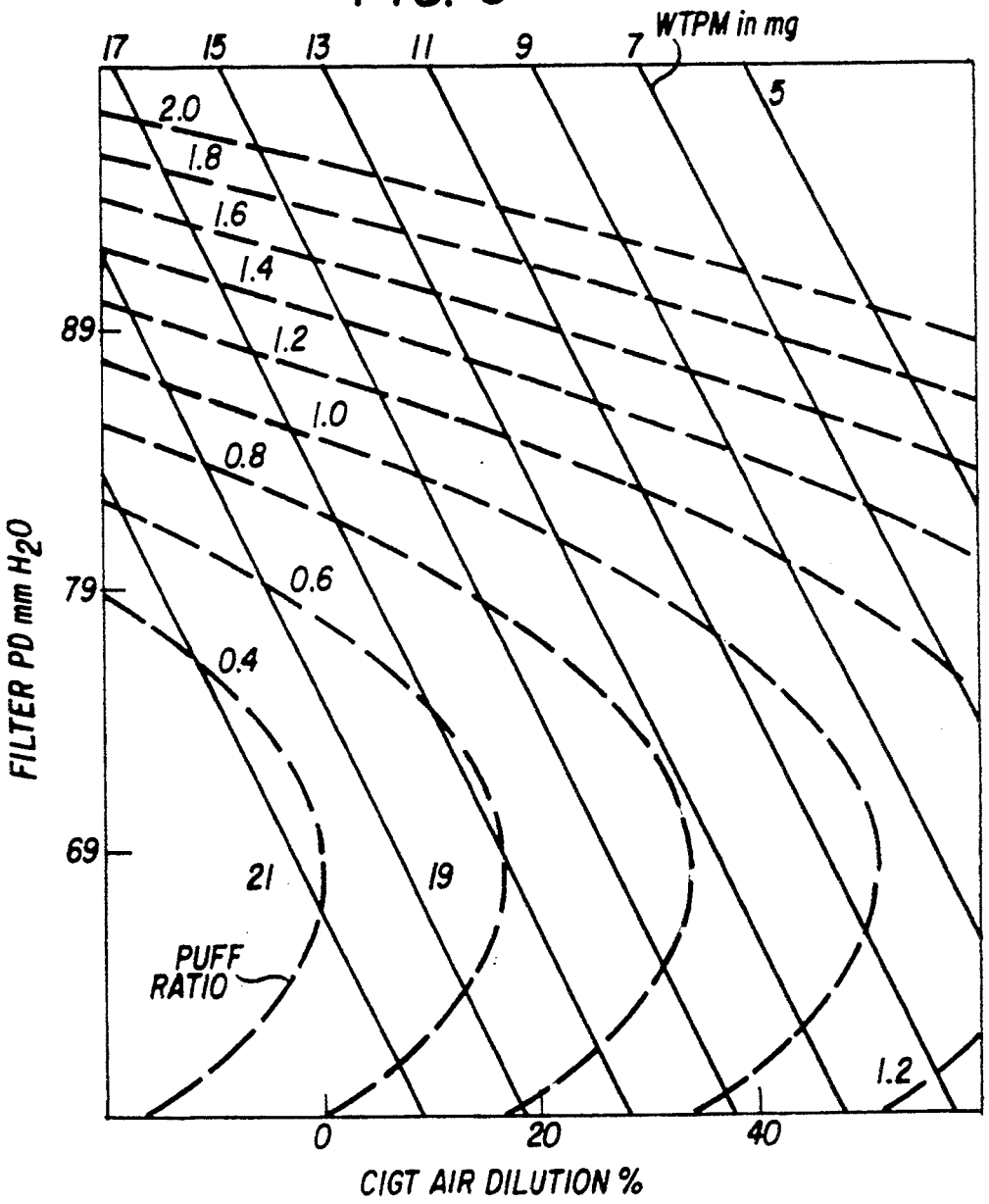

CONTROLLED DELIVERY SMOKING ARTICLE AND METHOD

FIELD OF THE INVENTION

The present invention relates to filtered smoking articles, such as cigarettes, in which the yield or delivery of particulate material, both total and per puff, is controlled and a method of making filtered smoking articles with predetermined total and per puff yields of particulate matter.

BACKGROUND OF THE INVENTION

It is well known that smoking articles, particularly conventional filtered or unfiltered cigarettes, provide an increasing per puff yield of particulate matter ("puff-to-puff yield") as the cigarette is smoked. In recent years, high efficiency filters and air dilution have been used to provide a lower total yield of particulate matter in the so-called "low tar" and "ultra low tar" cigarettes now available in the marketplace. Such high efficiency filters significantly increase the pressure drop of the cigarette and decrease yield, especially in the first few puffs of the cigarette. Air dilution helps to reduce the pressure drop somewhat, but also further reduces the per puff yield in the first few puffs. In combination, high filtration efficiency and air dilution configured in the conventional way in a cigarette not only produces the desired lower total yield, but also produces an undesirable per puff yield or puff profile of little yield in the first few puffs and a high yield in the final few puffs. Such a puff profile results in a perception by the smoker of a cigarette with inconsistent taste characteristics, i.e., little or no taste in the first few puffs and a harsh and overbearing taste in the final few puffs.

The prior art has attempted to address this problem in several ways. In one known construction of a cigarette smoking article, a compound filter is made up of two filter segments, a rod end segment and a mouth end segment. The rod end segment is made of a cellulose acetate fiber tow with a relatively high pressure drop thereacross (high efficiency) and which has been provided with one or more hollow cellulose acetate fibers or capillary tubes extending therethrough. The mouth end filter segment abuts the rod end filter segment and is made of a cellulose acetate fiber tow with a relatively low pressure drop thereacross (low efficiency). Air ventilation holes are provided in the rod end filter segment.

In a cigarette of the foregoing construction, during the first few puffs, a major portion of the smoke travels from the lighted end of the cigarette through the tobacco rod, through the capillary tube(s) in the rod end filter segment and thence through the low efficiency mouth end filter segment. This results in relatively unfiltered smoke, i.e., smoke with greater particulate matter and a better taste, reaching the smoker. A relatively small volume of smoke and air travels through the high efficiency filter and air ventilation holes of the rod end segment during the first few puffs because the pressure drop across the two filter elements is higher than the pressure drop through the capillary tube(s). As the smoker continues to smoke the cigarette, particulate matter or "tar" begins to accumulate at the mouth end of the capillary tube(s) where that end abuts the mouth end filter segment. Such accumulation is supposed to block the capillary tube(s) thereby increasing the pressure drop through the tube(s) and causing more of the higher yield smoke to flow through the high efficiency, air diluted filter surrounding the tubes. During the final few puffs when the per puff yield is highest, the capillary tubes are supposed to be substantially blocked so that most of the high yield smoke from the tobacco rod is more efficiently filtered and air diluted to maintain the per puff yield at a level substantially the same as the per puff yield of the first few puffs. The result is a cigarette with a substantially constant per puff yield.

It has been noted, for example, in European Patent Publication No. 0 481 596 that cigarettes having the above-described filter construction may exhibit significant variation in smoking characteristics which may render the cigarette commercially unacceptable. That publication suggests a modification of the known constructions by the addition of a third filter segment between the tobacco rod and the filter segment which carries a perforated capillary tube to achieve more consistent smoking characteristics.

U.S. Pat. Nos. 4,460,001 and 4,469,112 disclose a compound cigarette filter construction which is said to provide a substantially constant nicotine and tar delivery. A barrier positioned upstream of a filter segment is provided with one or more passageways through which the smoke passes. Buildup of tar in the filter segment downstream of the barrier results in an increasing blockage of flow which results in increased pressure drop and filtration efficiency and thereby yield a substantially constant nicotine and tar delivery.

U.S. Pat. Nos. 4,393,885 and 4,585,015 disclose a cigarette filter formed of an air or air ventilated pervious filter rod of cellulose acetate tow or the like with a central channel and a gas pervious partition disposed between the filter segment and the tobacco rod. An orifice in the partition communicates with the central channel and is gradually blocked by particulate matter during smoking to thereby increase the pressure drop and air ventilation resulting in a more constant per puff delivery of particulate matter.

Similar filter constructions for achieving a more constant per puff yield of particulate matter are disclosed in U.S. Pat. Nos. 4,291,712 and 4,942,887 and British Patent No. 1,428,018.

One of the drawbacks of the prior art constructions is the inconsistency of results which makes it virtually impossible to design and manufacture a commercially acceptable cigarette product based on the specifications and data provided in the prior art disclosures. An important reason for the inconsistency of results in the prior art constructions is believed to reside in the fact that compound filter constructions are subject to a large number of variables, such as the pressure drop across the individual filter segments, the pressure drop across the abutment or interface between filter segments, the pressure drop of capillary tubes used in the filter segments, the total pressure drop of the combination of filter elements, the amount of air ventilation, the location of the air ventilation holes, etc. One of the variables that is more difficult to control and is believed to account for much of the inconsistency of results of the above-described compound filter is the abutment resistance or pressure drop between the rod end and mouth end segments. This pressure drop has not been adequately accounted for in the prior art.

In addition, the development of a cigarette filter with a predetermined puff profile is usually based on a trial-and-error experimental approach. Even if a reasonably constant per puff yield can be achieved with a particular compound filter construction designed according to such an approach, if it is desired to change the total yield of particulate matter to a higher or lower level, the further changes that are necessitated in the filter design parameters to achieve that level are likely to also alter the puff profile of the cigarette requiring further trial-and-error experimentation.

It would be desirable therefore to develop models of a compound filter construction that would provide the key specifications for a filter construction based on a desired total yield of particulate matter, e.g., WTPM, within a range of WTPM and a desired puff profile from a constant or level per puff yield to a substantially decreasing per puff yield.

SUMMARY OF THE INVENTION

The present invention is directed generally to a cigarette smoking article with a compound filter design having dual filter segments, a mouth end segment and a tobacco rod end segment with one or more capillary tubes extending from end-to-end through the rod end segment in the same prior art arrangement described above. The abutment or interface flow resistance or pressure drop between the two filter segments is carefully controlled to a predetermined value for a given filter design and within a range for all filter designs according to the invention of from about 10 mm to about 100 mm water gauge. It has been found that this abutment resistance is subject to the greatest variation of any of the design parameters for a compound filter of the above-described construction.

If the abutment resistance is substantially zero or much lower than about 10 mm water gauge, the filter is inoperative or ineffective to cause gradual blockage of the capillary tube(s) in the rod end filter segment and the per puff yield increases resulting in a harsh taste during the last few puffs of the cigarette. If the abutment resistance is greater than about 100 mm water gauge, the capillary tube(s) are effectively blocked during the first few puffs and the draw resistance of the cigarette will be sufficiently high that the per puff yield of the first few puffs may be so low that the smoker receives inadequate initial taste and satisfaction, and may receive little or no satisfaction from smoking the entire cigarette. In addition, if the predetermined abutment resistance is not controlled within reasonably close tolerances for a given filter design, the total pressure drop for the filter will be so variable that a commercially acceptable cigarette cannot be economically manufactured in production quantities.

Experiments with cigarettes made with the compound filter design of the invention provide mathematical models that can be utilized to design a compound filter of the type described above that will provide a given total yield (WTPM) at a desired puff profile, such as a constant per puff yield or a decreasing per puff yield. The ability to control the puff profile of a cigarette makes it possible to reduce the total yield without compromising the taste perception of the smoker. It is possible, for example, to design a filter according to the invention with a per puff yield that decreases from the initial puffs to the final puffs. In this way, total yield can be markedly reduced over a conventional cigarette and even over a cigarette with a constant per puff yield if the first few puffs have a sufficient per puff yield to provide the necessary early taste and satisfaction to the smoker. Such lower total yield, decreasing puff profile cigarette styles may be perceived as better tasting and more acceptable to smokers because of several factors, namely, (a) a lower initial resistance to draw without loss of initial taste; (b) a reduced buildup of taste from the first to the last puff perceived as a smoother taste; and (c) lower total yield without decreased total yield satisfaction.

The Puff Ratio (PR) is an indication of the relationship between the yield of the early puffs with the yield of later puffs. Puff Ratio is determined by dividing the yield of the first two puffs by the yield of the last two puffs. Conventional filtered and unfiltered cigarettes have a Puff Ratio in the range of from about 0.5 to about 0.8 (i.e., an increasing per puff yield) regardless of the total yield which may range from about 35 mg WTPM for an unfiltered cigarette to about 6–8 mg WTPM for an ultra low tar cigarette. For a cigarette filter with a constant per puff yield, the Puff Ratio is 1.0 and for a cigarette filter with a decreasing per puff yield, the Puff Ratio is greater than about 1.2 and is typically in the range of from about 1.2 to about 2.5.

With the foregoing and other advantages and features of the invention that will become hereinafter apparent, the nature of the invention may be more clearly understood by reference to the following detailed description of the invention, the appended claims and to the several views illustrated in the drawings.

BRIEF DESCRIPTION OF THE DRAWINGS

FIG. 1 is a fragmentary perspective view of a smoking article with a compound filter constructed according to the invention;

FIG. 2 is a cross-sectional view of the smoking article of FIG. 1 taken along line 2—2;

FIG. 3 is a cross-sectional view of the smoking article of FIGS. 1 and 2 taken along line 3—3 of FIG. 2;

FIGS. 3A–G are cross-sectional views of a smoking article according to the invention illustrating various alternative constructions of the filter segments;

FIG. 4 is a cross-sectional view of a four-up filter construction from which the compound filter of the present invention is made; and FIG. 5 is a regression chart of the mathematical models developed according to the invention for a particular compound filter construction of the type shown in FIGS. 1–3.

DETAILED DESCRIPTION OF THE INVENTION

Figure 3C:
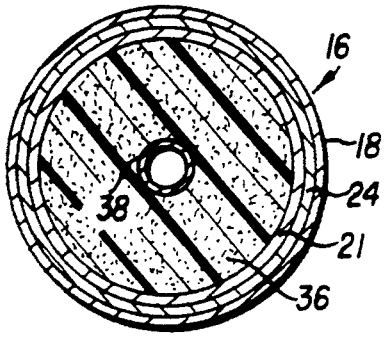

Referring now in detail to the drawings, there is illustrated in FIGS. 1–3 a smoking article according to the invention, such as a cigarette, which is designated generally by reference numeral 10. Cigarette 10 comprises a tobacco rod 12 wrapped with a standard cigarette paper 14 and a compound filter 16 attached to the tobacco rod 12 with a standard non-porous tipping paper 18. The compound filter 16 is configured generally according to a known filter construction with a rod end filter segment 20 and a mouth end filter segment 22. Each filter segment 20, 22 is wrapped with a standard non-porous paper plug wrap 21, 23, respectively, and the two segments are combined with the same type of paper plug wrap 24 to form an interface 25 therebetween. The rod end filter segment 20 is provided with a centrally located passage or capillary tube 26 which extends the full length of the rod end filter segment 20. Air dilution holes 28 are provided about the circumference of the rod end segment 20 of the filter 16 and extend through the tipping paper 28, the combiner paper 24 and the plug wrap 21. Generally, operation of the filter 16 is as described above in connection with the prior art filter of the same construction.

The tube 26 in the rod end filter segment 20 is preferably made of a weight mixture of about 66% cellulose acetate; about 33% triacetin and about 1% Tritanox and may be purchased as an indeterminate length of tubing from Sunlite Plastics, Inc., Germantown, Wis. under the designation VYSUN 901-A-01 (white). The inside diameter of the tube 26 may be selected from the range of about 45 mils to about 60 mils with a wall thickness of about 4 mils. The tube 26 may also be made of paper or extruded polymers. As shown in FIGS. 3A and 3B, the central passage may also be formed as a plurality or bundle of smaller diameter tubes 30 (FIG. 3A) or as an extruded cylindrical rod 32 with a plurality of longitudinal channels 34 extending therethrough (FIG. 3B).

The filter segments 20, 22 are preferably made of a cellulose acetate tow having from 0% to about 12% by weight of triacetin that may include carbowax and/or a flavorant in an amount of up to about half the weight of the triacetin. In lieu of cellulose acetate tow, the segments 20, 22 may be made of a gathered web of paper or polymer which may include, or be coated with organic or inorganic taste modifiers or other materials for reducing unwanted constituents of the mainstream smoke. The segments 20, 22 may also be made of a controlled porosity foam structure with or without the plug wraps 21, 23. FIG. 3C illustrates an embodiment of a rod end filter segment made of an open-celled foam 36 with an impervious tube 38 extending coaxially therethrough.

Figure 3E:
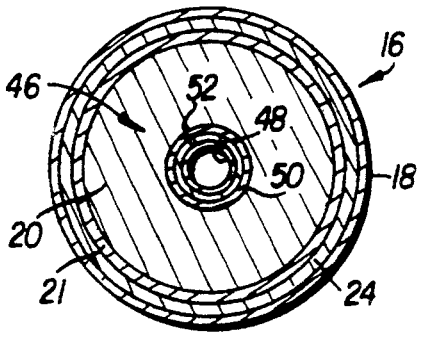
Figure 3D:
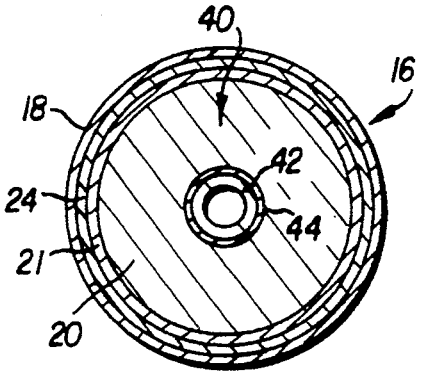

The central tube of the rod end filter segment may incorporate an organic or inorganic flavorant material to enhance taste, especially of the initial puffs of the cigarette. A LDPE or HDPE or a mixture thereof may be blended with about 0.1% up to about 70% by weight of a flavorant and formed into a tube encapsulated on the outside thereof with a continuous barrier layer of EVOH, nylon or polyester to prevent migration of the flavorant in the tube to the surrounding filter material. The polarity and crystallinity of the tube polymer may be adjusted to vary the release of flavor. FIG. 3D illustrates a two-layer tube 40 comprising an inner layer 42 of a flavorant blended LDPE or HDPE and an encapsulating layer 44. FIG. 3E illustrates a three-layer tube 46 with inner and outer flavorant blended layers 48, 50 and a middle barrier layer 52 for preventing migration between the flavorant layers 48, 50. This layer embodiment may be used, for example, where different flavor layers or differently yielding flavor layers of the same flavorant are used in combination.

Figure 3G:
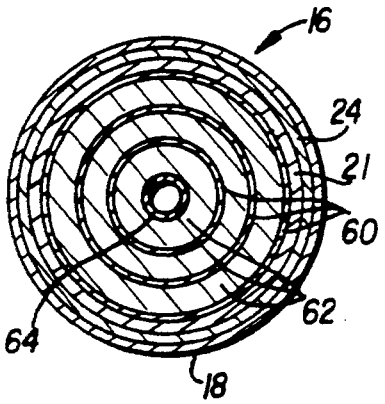
Figure 3F:
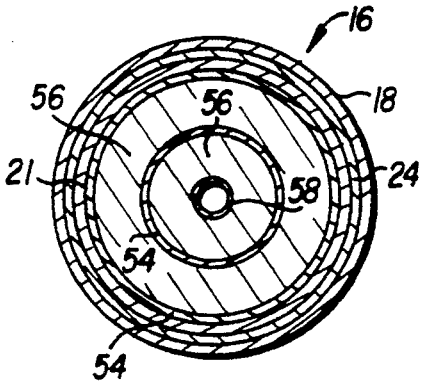

As shown in FIGS. 3F and 3G, the rod end filter segment may be formed with one or more concentric layers of carbon sheet alternating with cellulose acetate tow. FIG. 3F, for example, illustrates a rod end filter segment with two concentric carbon sheet layers 54 alternating with two concentric layers of cellulose acetate tow 56 with a central tube 58 which may also be made of carbon. FIG. 3G illustrates a rod end filter segment with three concentric carbon sheet layers 60 alternating with three concentric layers of cellulose acetate tow 62 with a central tube 64 which may also be made of carbon. Concentric carbon layers may also be used in the mouth end filter segment.

Normally the carbon tube and carbon sheets are used to remove certain gas phase components of the smoke. See, for example, U.S. Pat. No. 3,101,723. Also see U.S. patent application Ser. No. 07/898,111 filed Jun. 12, 1992, which is incorporated herein by reference. If desired, the carbon tube 58 can be made of other materials disclosed herein, such as polymers, and a flavorant may be included in the concentric carbon sheets. In such an embodiment, as the cigarette is smoked, a major portion of the smoke will travel through the center tube until such time as the particulate matter accumulates at the mouth end of the tube where it abuts with the mouth end filter segment. As the build-up increases, the pressure drop through the tube increases, and the major portion of the smoke then begins to travel through the cellulose acetate portion of the filter segment past the concentric carbon sheets. Furthermore, during smoking the burning fire cone progresses down the tobacco rod toward the filter, thus increasing the heat which is transferred to the filter. The flavorant and the concentric carbon sheet material can be selected so that the flavorant is given off to provide additional flavor to the smoke or to provide flavor to the last few puffs to produce a pleasant aftertaste.

It will be appreciated by those skilled in the art that the segments of the compound filter may be made from longer rod segments of the mouth end filter and the rod end filter. The filter rods may be made on a Hauni KDF filter maker or an extruder manufactured, for example, by Killion Extruders, Inc., of Cedar Grove, N.J. In the case of the rod end filter segments, the central tube may be drawn by the surrounding tow from a spool and compressed into the filter rod at the garniture of the Hauni filter maker. Alternatively, a laser beam may be used to form the tube(s) in the manner described in U.S. Pat. No. 4,291,712. The filter segments may be combined, for example, in a MULFI PTC filter combiner, in the form of a four-up filter as shown in FIG. 4 and as designated generally by reference numeral 70. By cutting the four-up filter 70 along transverse planes 72, 74 and 76, four compound filters of the type shown in FIGS. 1–3 are formed. Since the four-up filter 70 includes four abutments or interfaces 78, 80, 82, 84 between the two double length mouth end filter segments 86, 88 and the three rod end filter segments (one a double length segment) 90, 91, 92 the pressure drop across the four-up filter 70 will be substantially the same as the sum of the pressure drops across four individual filters. Moreover, since variations in pressure drop of individual filters are more likely to be the result of improper abutment between the mouth end and rod end segments, such pressure drop variations will ordinarily be increased by a factor of four in the four-up filter 70 making it easier to detect improperly combined filter rod segments. The interface or abutment resistance or pressure drop should be set at a predetermined value in the range of from about 10 mm to about 100 mm water gauge and should not vary from that value by more than about 5 mm water.

After the compound filters 16 are attached to the tobacco rods 12 by tipping paper 18, the cigarettes are perforated by a mechanical or laser perforator at the desired vent location. A preperforated tipping paper and porous plug wraps may also be used to provide the air vents at the proper location in a conventional manner. The preferred location of the air vents for the compound filter of the invention is in the rod end segment 20 approximately 2–5 mm from the interface 25 between the rod end segment 20 and the mouth end segment 22. For other compound filter designs, it may be desirable to perforate the rod end segment 2–5 mm from the tobacco rod, for example, when it is desired to enhance a tube flavorant.

A designed experiment was conducted on cigarettes that were made to test the variables of air dilution and abutment pressure drop. The test cigarettes were provided with filters having a 14 mm length mouth end segment of 8.0/40,000 dpf yielding a pressure drop of 25 mm water, a 17 mm length rod end filter segment of 1.6/48,000 dpf with a 0.048 inch ID center tube yielding a tube closed pressure drop of 200 mm water and a tobacco rod of 57 mm length from a typical light brand, i.e., CAMEL Lights KS. The data from this experiment was statistically analyzed to provide mathematical formulas which can be used to predict the WTPM and Puff Ratio possibilities of the compound filter design and tobacco rod combination of the test cigarettes, For the particular compound filter and tobacco rod design of the test cigarettes, the following mathematical models or formulas were determined by the designed experiment:

The formula for total particulate matter is:

(1) $WTPM=13.9-4.1(CAD)-2.4(FPD)$ where

WTPM is Wet Total Particulate Matter in milligrams (mg);

CAD is cigarette air dilution expressed as a fraction; and

FPD is the filter pressure drop in millimeters (mm) of water gauge and includes the pressure drop of the tobacco rod end segment, the pressure drop of the mouth end segment and the pressure drop of the abutment between the filter segments.

The formula for Puff Ratio (PR) is:

(2)

$PR=0.884+0.236(CAD)+0.469(FPD)+0.222(FPD)^2$

Using the above formulas, a regression chart shown in FIG. 5 was prepared with Puff Ratio curves from 0.4 to 2.0 superposed on WTPM lines of 5 mg to 21 mg total yield per cigarette. When a desired Puff Ratio and WTPM are chosen for a particular type of cigarette, the chart provides a means for easily determining the specifications for filter pressure drop (FPD) and air dilution (CAD). Thus, the regression chart provides the cigarette developer with the means to design a range of different cigarette types, with different tastes and puff profiles using substantially the same filter components by varying primarily the air dilution and the abutment pressure drop.

It should be noted that the regression chart of FIG. 5 is specific to the particular compound filter and tobacco rod combination for which the designed experiment was performed. It should also be noted that the WTPM and Puff Ratio curves outside the filter pressure drop range of 69–89 mm and outside the air dilution range of 0% to 40% were not derived from actual test data. If the regression chart is to be used outside those ranges above 0% air dilution, the curves for WTPM and Puff Ratio should be verified by experiment.

Assume it is desired to make a cigarette of the test cigarette configuration with a constant per puff yield (PR=1.0) and a total yield (WTPM) of about 12 mg. For that cigarette, the specifications for the compound filter pressure drop (FDP) and air dilution (CAD) would be about 79 mm and about 30%, respectively, as determined from the regression chart of FIG. 5.

For any compound filter design of the type to which this invention pertains, the measured values of the flow resistance for selected filter components, such as the values of those components listed in Table I below, can be used to determine the required abutment pressure drop. So long as this abutment pressure drop is a value within the range of about 10 mm to about 100 mm and is maintained substantially the same from filter to filter as manufactured, a consistent Puff Ratio and WTPM will result from cigarette to cigarette.

TABLE I

| Filter Component | Filter Component Flow Resistance: PD in mm $H_2O$ 10 mm length | PD in mm $H_2O$ 20 mm in length |
|---|---|---|
| 48 mil ID Tube | 44 | 56 |
| 60 mil ID Tube | 14 | 17 |
| 1.6/48,000 dpf Tow | 116 | 222 |
| 2.1/48,000 dpf Tow | 83 | 151 |
| 2.7/48,000 dpf Tow | 60 | 120 |
| 3.3/39,000 dpf Tow | 31 | 62 |
| 3.9/35,000 dpf Tow | 46 | 82 |

The above values of flow resistance in Table I are merely representative. Values of flow resistance for other tube configurations, including multiple tubes, and other tow and filter configurations, including gathered webs, foams, etc., and other lengths of filter design components can also be measured and used to construct a cigarette which can be tested for the purpose of providing WTPM and Puff Ratio formulas and a regression chart for that particular design.

EXAMPLE 1

This example is a cigarette prototype E8 with a Puff Ratio of 1.0 and a total yield (WTPM) of about 13 mg.

| | | |
|---|---|---|
| Tobacco Rod | Length: | 57 mm |
| | Circumference: | 24.75 mm |
| | Cigarette Paper: | (454) Standard |
| | Blend: | CLT85 Standard leaf blend, casing, and top dressing components |
| Filter | Length: | 31 mm |
| | Circumference: | 24.43 mm |
| | Combiner Wrap: | (646) Standard non-porous paper |
| | Pressure drop: | 65 mm |
| | Abutment pressure drop: | 10 mm |
| | Mouth-end Filter Segment: | |
| | Length: | 14 mm |
| | Circumference: | 24.18 mm |
| | Tow: | 8.0/40000 dpf |
| | Plasticizer: | 6.4% Triacetin |
| | Plug Wrap: | (646) Standard non-porous paper |
| | Pressure Drop: | 25 mm |
| | Weight: | 0.1051 g |

-continued

| | | |
|---|---|---|
| | Tobacco-end Filter Segment: | |
| | Length: | 17 mm |
| | Circumference: | 24.18 mm |
| | Tow: | 1.6/48000 dpf |
| | Plasticizer: | 7.4% Triacetin |
| | Tube(s): | One VYSUN 901-A-01 tube 0.048 inch I.D. +0.0015 inch and 0.004 inch wall thickness |
| | Plug Wrap: | (646) Standard non-porous paper |
| | Pressure Drop: | 30 mm (Tube(s) Open); 200 mm (Tube(s) Closed) |
| | Weight: | 0.1743 g |
| Tipping Paper | Standard non-porous cork-on-white | |
| Vent Location | 19 mm from the mouth-end of the cigarette | |
| Air Dilution | 40% | |
| WTPM | 13.1 mg/Cigarette | |
| Puff Count | | 8 Puffs/Cigarette |
| Puff Ratio | | 1.00 |

EXAMPLE 2

This example is a cigarette prototype D7 with a Puff Ratio of 1.8 and a total yield (WTPM) of 7.4 mg.

| | | |
|---|---|---|
| Tobacco Rod | Length: | 57 mm |
| | Circumference: | 24.75 mm |
| | Cigarette Paper: | (454) Standard |
| | Blend: | CLT85 Standard leaf blend, casing, and top dressing components |
| Filter | Length: | 31 mm |
| | Circumference: | 24.43 mm |
| | Combiner Wrap: | (646) Standard non-porous paper |
| | Pressure drop: | 85 mm |
| | Abutment pressure drop: | 28 mm |
| | Mouth-end Filter Segment: | |
| | Length: | 14 mm |
| | Circumference: | 24.18 mm |
| | Tow: | 8.0/40000 dpf |
| | Plasticizer: | 6.4% Triacetin |
| | Plug Wrap: | (646) Standard non-porous paper |
| | Pressure Drop: | 27 mm |
| | Weight: | 0.1051 g |
| | Tobacco-end Filter Segment: | |
| | Length: | 17 mm |
| | Circumference: | 24.18 mm |
| | Tow: | 1.6/48000 dpf |
| | Plasticizer: | 7.4% Triacetin |
| | Tube(s): | One VYSUN 901-A-01 tube 0.048 inch I.D. +0.0015 inch and 0.004 inch wall thickness |
| | Plug Wrap: | (646) Standard non-porous paper |
| | Pressure Drop: | 30 mm (Tube(s) Open); 200 mm (Tube(s) Closed) |
| | Weight: | 0.1743 g |
| Tipping Paper | Standard non-porous cork-on-white | |
| Vent Location | 19 mm from the mouth-end of the cigarette | |
| Air Dilution | 40% | |
| WTPM | 7.4 mg/Cigarette | |
| Puff Count | | 9 Puffs/Cigarette |
| Puff Ratio | | 1.80 |

Tables II and III show smoke profiles with per puff and total WTPM data for the E8 and D7 prototypes of Examples 1 and 2 as well as for a number of prototype cigarettes with differently constructed filters. Prototypes with level per puff yields are shown in Table II and prototypes with decreasing per puff yields are shown in Table III. The prototypes are listed in decreasing amount of total yield (WTPM).

TABLE II

Cigarette Puff Profile Data
WTPM Values in mg for 1–9 Puffs
Level Puff Profile

| 1 | 2 | 3 | 4 | 5 | 6 | 7 | 8 | 9 | Total | PR | |
|---|---|---|---|---|---|---|---|---|---|---|---|
| E1 | 1.6 | 1.7 | 1.8 | 1.7 | 1.8 | 1.8 | 1.8 | 1.8 | 1.3 | 14.8 | 0.92 |
| E2 | 1.7 | 1.7 | 1.8 | 1.9 | 1.8 | 1.7 | 1.8 | 1.7 | 1.0 | 14.4 | 0.98 |
| E8 | 2.1 | 1.3 | 1.2 | 1.7 | 1.8 | 1.6 | 1.7 | 1.7 | — | 13.1 | 1.00 |
| E3 | 1.0 | 1.1 | 1.3 | 1.1 | 1.2 | 1.3 | 1.0 | 0.9 | — | 8.9 | 1.11 |
| E4 | 1.2 | 1.2 | 1.1 | 1.3 | 1.1 | 1.3 | 1.4 | — | — | 8.6 | 0.89 |
| E5 | 1.0 | 1.0 | 1.1 | 1.1 | 1.1 | 0.7 | 0.9 | 1.1 | — | 8.0 | 1.00 |
| E6 | 1.1 | 0.8 | 0.8 | 0.9 | 0.7 | 0.8 | 0.8 | 0.9 | — | 6.8 | 1.12 |
| E7 | 0.7 | 0.5 | 0.5 | 0.4 | 0.6 | 0.4 | 0.6 | 0.6 | 0.6 | 4.9 | 1.00 |

TABLE III

| | Decreasing Puff Profile | | | | | | | | | | |
|---|---|---|---|---|---|---|---|---|---|---|---|
| | 1 | 2 | 3 | 4 | 5 | 6 | 7 | 8 | 9 | Total | PR |
| D1 | 1.5 | 1.3 | 1.5 | 1.3 | 1.5 | 1.5 | 1.1 | 1.0 | — | 10.7 | 1.33 |
| D4 | 1.5 | 1.5 | 1.5 | 1.2 | 1.2 | 1.0 | 1.0 | 0.8 | — | 9.7 | 1.67 |
| D2 | 1.4 | 1.3 | 1.0 | 1.3 | 0.9 | 0.8 | 0.8 | 1.2 | — | 8.7 | 1.35 |
| D3 | 1.3 | 1.4 | 1.2 | 1.1 | 1.0 | 0.9 | 0.8 | 0.7 | — | 8.4 | 1.80 |
| D7 | 1.0 | 1.0 | 0.9 | 1.0 | 0.9 | 0.8 | 0.7 | 0.5 | 0.6 | 7.4 | 1.80 |
| D5 | 0.9 | 0.9 | 0.8 | 0.5 | 0.7 | 0.6 | 0.8 | 0.4 | — | 5.6 | 1.50 |
| D6 | 0.8 | 0.7 | 0.6 | 0.4 | 0.6 | 0.6 | 0.6 | 0.6 | — | 4.3 | 1.25 |

It will be appreciated frown the foregoing that the present invention provides a unique way of designing cigarettes with a desired puff profile and total yield. In addition, according to the present invention, by appropriate selection of air dilution and pressure drop for the particular compound filter design, a decreasing per puff yield can be advantageously attained.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A filter for a smoking article comprising a mouth end filter segment and a rod end filter segment, said rod end filter segment having a passage extending longitudinally therethrough, said filter segments being in abutting relationship with an abutment interface therebetween, said abutment interface having a pressure drop in the range of from about 10 mm to about 100 mm water gauge, and air dilution means disposed in one of said filter segments for admitting ventilating air into said filter.

2. The filter according to claim 1, wherein said filter has a total pressure drop thereacross which includes the pressure drop of said abutment interface and the pressure drops across said mouth end and rod end segments, the total pressure drop of said filter and the amount of ventilating air admitted to said filter being selected to provide a substantially level per puff yield of wet particulate matter from the first puff to the last puff of the smoking article.

3. The filter according to claim 1, wherein said filter has a total pressure drop thereacross which includes the pressure drop of said abutment interface and the pressure drops across said mouth end and rod end segments, the total pressure drop of said filter and the amount of ventilating air admitted to said filter being selected to provide a decreasing per puff yield of wet particulate matter from the first puff to the last puff of the smoking article.

4. The filter according to claim 1, wherein said passage comprises at least one tube having an inside diameter in the range of about 45 mils to about 60 mils.

5. The filter according to claim 1, wherein said passage comprises a plurality of tubes or a rod with a plurality of channels extending longitudinally therethrough.

6. The filter according to claim 4, wherein said tube is fabricated from an extruded polymer or paper.

7. The filter according to claim 4, wherein said tube includes an organic or inorganic flavorant.

8. The filter according to claim 1, wherein said rod end filter segment comprises cellulose acetate tow having one or more concentric layers of carbon sheet material disposed in said tow.

9. The filter according to claim 8, wherein said passage comprises a carbon tube disposed axially of said rod end filter segment and coaxially with said concentric layers of carbon sheet material.

10. The filter according to claim 1, wherein said air dilution means are disposed in said rod end segment, said air dilution means comprising perforations in the periphery of said rod end segment.

11. The filter according to claim 1, wherein said perforations are disposed from about 2 mm to about 5 mm from said abutment interface.

12. The filter according to claim 1, wherein said mouth end segment and said rod end segment comprise one of a cellulose acetate tow, a gathered web of paper or polymer sheet, or an open-cell foam.

13. A cigarette comprising a tobacco rod and a filter, said filter having a pressure drop thereacross and comprising a mouth end segment and a rod end segment having a passage extending longitudinally therethrough, said filter segments being disposed in abutting relationship with an abutment interface therebetween, the pressure drop across said abutment interface being in the range from about 10 mm to about 100 mm water gauge, said tobacco rod being affixed to said rod end segment, air dilution means in said filter for admitting ventilating air into said filter, the pressure drop across said filter and the amount of ventilating air admitted to said filter being selected so as to produce a decreasing per puff yield of wet particulate matter from the first to the last puff of the cigarette.

14. The cigarette according to claim 13, wherein the cigarette has a Puff Ratio greater than about 1.2 wherein Puff Ratio is defined as the wet particulate matter of the first two puffs of the cigarette divided by the wet particulate matter of the last two puffs of the cigarette.

15. The cigarette according to claim 14, wherein the Puff Ratio is in the range from about 1.2 to about 2.5.

16. A cigarette comprising a tobacco rod and a filter, said filter having a pressure drop thereacross and comprising a mouth end segment and a rod end segment having a passage extending longitudinally therethrough, said filter segments being disposed in abutting relationship with an abutment interface therebetween, the pressure drop across said abutment interface being in the range of from about 10 mm to about 100 mm water gauge, said tobacco rod being affixed to said rod end segment, air dilution means in said filter for admitting ventilating air into said filter, at least one carbon sheet containing a flavorant disposed in the rod end segment surrounding said passage.

17. The cigarette according to claim 16, wherein said carbon sheet is concentrically disposed relative to said passage.

18. The cigarette according to claim 16, including a plurality of said carbon sheets disposed in spaced concentric relation to said passage.

19. The cigarette according to claim 16, wherein said filter has a total pressure drop thereacross which includes the pressure drop of said abutment interface and the pressure drops across said mouth end and rod end segments, the total pressure drop of said filter and the amount of ventilating air admitted to said filter being selected to provide a substantially level per puff yield of wet particulate matter from the first puff to the last puff of the smoking article.

20. The cigarette according to claim 16, wherein said filter has a total pressure drop thereacross which includes the pressure drop of said abutment interface and the pressure drops across said mouth end and rod end segments, the total pressure drop of said filter and the amount of ventilating air admitted to said filter being selected to provide a decreasing puff per yield of wet particulate matter from the first puff to the last puff of the smoking article.

21. The cigarette according to claim 16, wherein said rod end filter segment comprises cellulose acetate tow having one or more concentric layers of carbon sheet material disposed in said tow.

22. A method of controlling the delivery of particulate matter from a cigarette during smoking, comprising the steps of:

making a four-up filter comprising four filters, each filter having a pressure drop thereacross and comprising a mouth end segment and a rod end segment having a passage extending longitudinally therethrough, said filter segments being disposed in abutting relationship with an abutment interface therebetween, said four up filter including four of said abutment interfaces;

measuring the pressure drop across said four-up filter;

constructing a cigarette comprising a tobacco rod and one filter of said four-up filter by affixing the tobacco rod to the rod end segment of said one filter and providing air dilution means in said one filter for admitting ventilating air into such a filter, and controlling the pressure drop across said one filter and the amount of ventilating air admitted to such filter so as to produce a decreasing per puff yield of wet particulate matter from the first puff to the last puff of the cigarette.

23. The method of claim 22, wherein said controlling step includes the step of controlling the pressure drop across each abutment interface to a range of about 10 mm to about 100 mm water gauge.

24. The method of claim 23, including the further step of controlling the difference between the pressure drops across the abutment interfaces to about 5 mm water gauge.

25. A method of making a cigarette having a controlled delivery of particulate matter comprising the step of:

making a four-up filter comprising four filters, each filter having a pressure drop thereacross and comprising a mouth end segment and a rod end segment having a passage extending longitudinally therethrough, said filter segments being disposed in abutting relationship with an abutment interface therebetween, said four-up filter including four of said abutment interfaces;

measuring the pressure drop across said four-up filter;

determining the average pressure drop across each abutment interface of said four-up filter; and forming cigarettes using only filters from four-up filters which have an average pressure drop across the abutment interfaces between about 10 mm to about 100 mm water gauge.

* * * * *